US008479663B2

(12) United States Patent
Davis

(10) Patent No.: US 8,479,663 B2
(45) Date of Patent: Jul. 9, 2013

(54) PORTABLE ENTERTAINMENT SYSTEM

(76) Inventor: Ray Charles Davis, Lufkin, TX (US)

( * ) Notice: Subject to any disclaimer, the term of this patent is extended or adjusted under 35 U.S.C. 154(b) by 0 days.

(21) Appl. No.: 13/160,470

(22) Filed: Jun. 14, 2011

(65) Prior Publication Data

US 2011/0278197 A1 Nov. 17, 2011

Related U.S. Application Data

(63) Continuation-in-part of application No. 11/897,622, filed on Feb. 19, 2008, now abandoned.

(51) Int. Cl.
*A47B 3/00* (2006.01)

(52) U.S. Cl.
USPC ..... 108/35; 297/139

(58) Field of Classification Search
USPC ... 108/38, 34, 35, 36, 13, 158, 50.12; 297/17, 297/139, 158.4, 158.5, 158.3, 378.1
See application file for complete search history.

(56) References Cited

U.S. PATENT DOCUMENTS

| | | | | | |
|---|---|---|---|---|---|
| 1,287,444 | A * | 12/1918 | Rudy | 108/36 |
| 1,622,327 | A * | 3/1927 | Livingood | 297/139 |
| 1,850,420 | A * | 3/1932 | Schuldt | 273/284 |
| 2,109,869 | A * | 3/1938 | Lon | 297/143 |
| 2,827,352 | A * | 3/1958 | Boyajian | 108/35 |
| 4,869,551 | A * | 9/1989 | Lathers | 297/440.1 |
| 4,887,536 | A * | 12/1989 | Teichner | 108/35 |
| 5,483,904 | A * | 1/1996 | Kelly et al. | 108/156 |
| 5,660,117 | A * | 8/1997 | Noble | 108/35 |
| 6,016,756 | A * | 1/2000 | McMahon et al. | 108/158 |
| 2002/0014797 | A1 * | 2/2002 | Dudash et al. | 297/452.29 |

* cited by examiner

*Primary Examiner* — Jose V Chen
(74) *Attorney, Agent, or Firm* — Delphine James

(57) ABSTRACT

A collapsible multi-play entertainment table includes a first section and a second section hingedly attached together by a hinging device. A plurality of leg members are removably attached to the underside of the folding table. The top surface of the folding table is adapted with an indentation for receiving a game table insert. The game table insert can be for any type of desired game such as chess, checkers, poker, plain or another suitable game. An assembly of collapsible chairs is included.

17 Claims, 5 Drawing Sheets

FIGURE 3
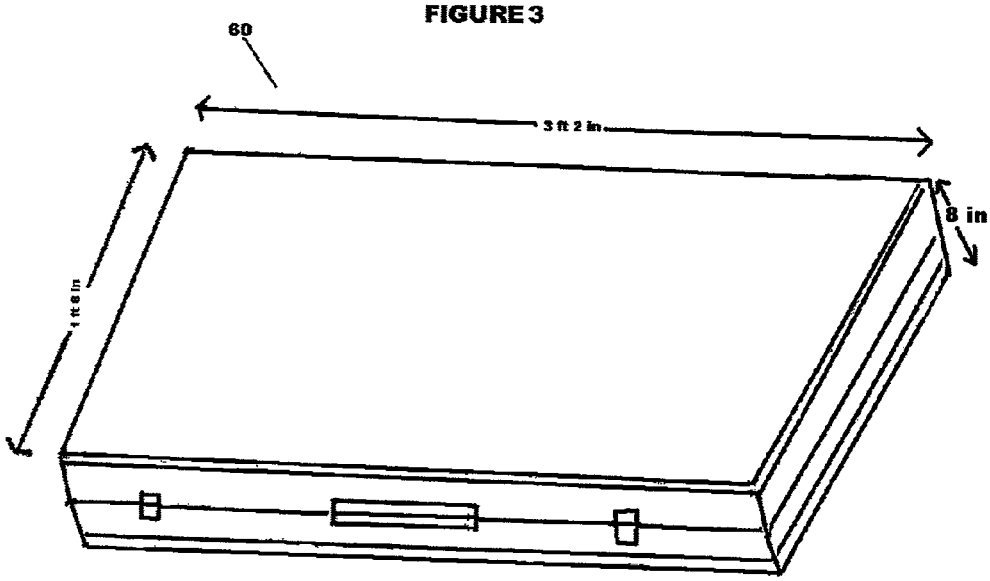
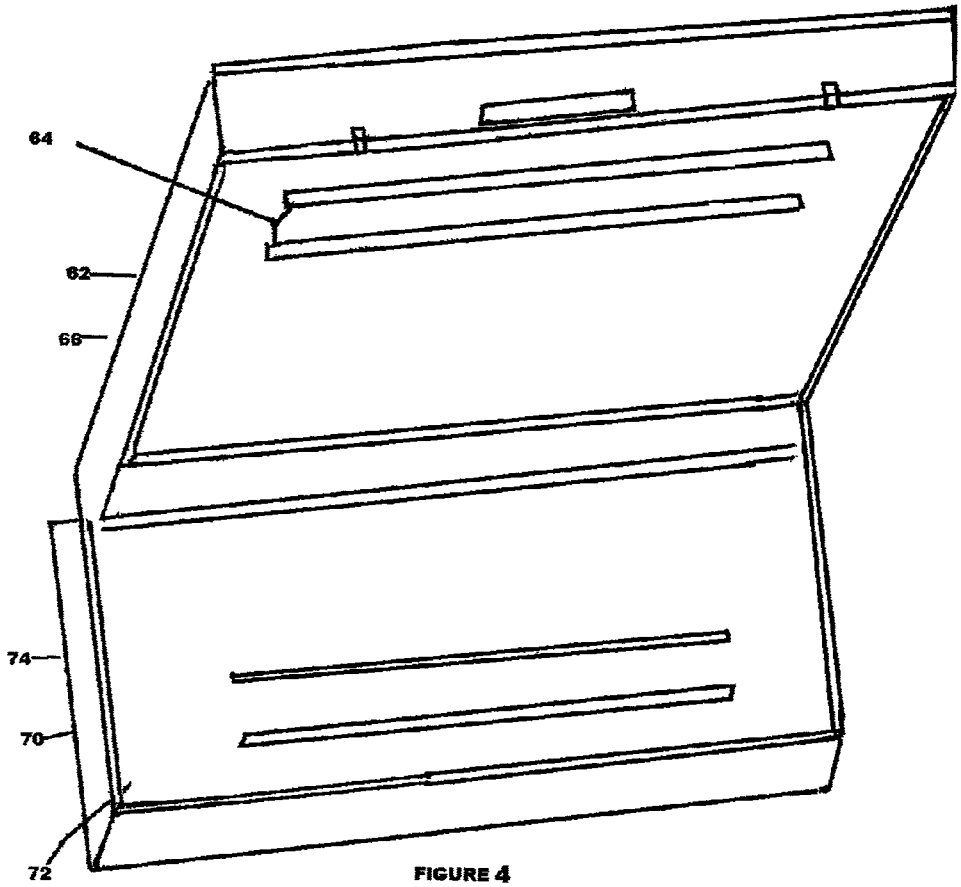
FIGURE 4

PORTABLE ENTERTAINMENT SYSTEM

This is a continuation in part of application Ser. No. 11/897,622 filed Feb. 19, 2008 now abandoned.

BACKGROUND

This invention relates to portable entertainment tables. More particularly, the invention relates to a portable table with chairs that can be folded into a self-contained package. The most common types of portable tables are card tables. The legs of the card tables normally collapse and fold upward. There are numerous common portable table designs. Additionally, several patents have been issued on numerous designs such as. However, this invention provides a unique design for a multi-play entertainment table.

SUMMARY OF THE INVENTION

An object of this invention is to provide a portable table that may be easily converted from a compact state into a stable sturdy entertainment table with chairs.

The present invention, a collapsible multi-play entertainment table includes a first section and a second section hingedly attached together by a hinging device. A plurality of leg members are removably attached to the underside of the folding table. The top surface of the folding table is adapted with an indentation for receiving a game table insert. The game table insert can be for any type of desired game such as chess, checkers, poker, plain or another suitable game. An assembly of collapsible chairs and a carrying case are included.

One of the main advantages of the present invention is that it provides a self-contained, fully functional table that can be easily transported and stored when not in use.

IN THE DRAWING

FIG. 3 is a top view of the carrying case closed.

FIG. 4 is a top view of the carrying case opened.

DETAIL SPECIFICATIONS

Figure 1:
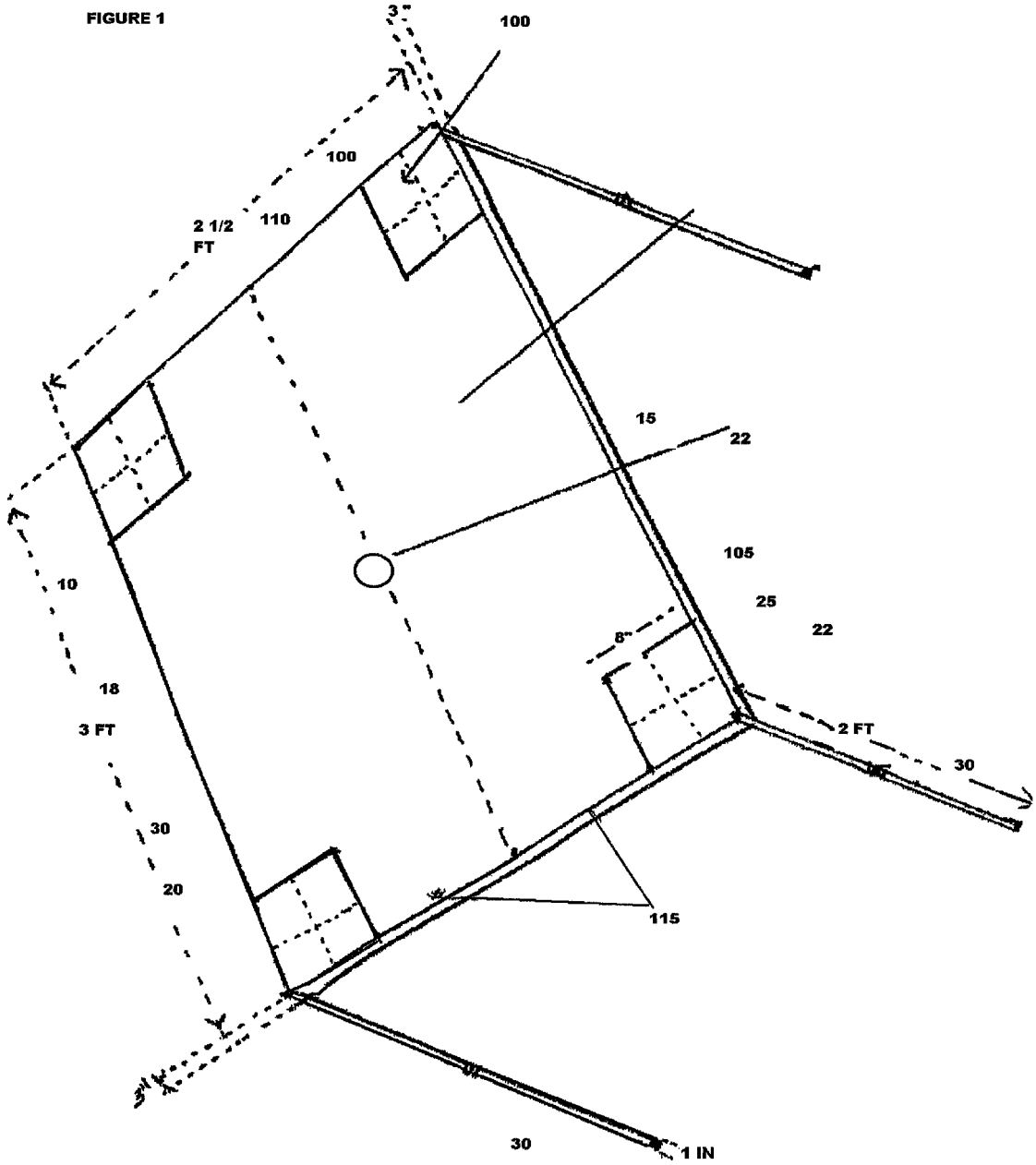
FIG. 1 is a full perspective view of the table of the present invention.

As shown in FIG. 1, an embodiment of the present invention designated as numeral 10 includes a supporting frame 17 supporting table insert 20. Table insert 20 includes two half sections (20, 25) forming a rectangular shaped top surface. Additionally frame 17 is segmented into two half sections (10, 15) forming a rectangular opened surface adapted to receive half sections (20, 25) of table insert 20. The shape of the frame 17 and table insert 20 are not limited to rectangular, but can be other suitable polygonal shapes. In the preferred embodiment, the table is three feet long by two and one-half feet wide. Frame 17 can be made of metal, wood, or another suitable material.

The present invention further includes a flat table insert (20) that is removable from frame 17. Table insert 20 can be adapted with any covering to support the desired game such as checkers, chess, or poker. Additionally, table insert 20 can be plain to support a regular table top for dominoes. Along the perimeter and peripheral edge of frame 17 is an indentation 18, which is adapted to securely receive the peripheral edge of table insert 20. Table insert 20 and frame 17 are adapted with equivalent shape and dimensions.

As shown, frame 17 includes half sections 10 and 15 that are hinged together so that each section can pivot with respect to each other. To allow frame 17 to pivot, hinged device 32 is centrally located on side edges 50 and 55. Thus, allowing frame 17 to pivot along the central axis 22. In the depicted open state, the two half sections 10 and 15 are pivoted such that they lay adjacent to each other. However, in the closed state, the two half sections 10 and 15 are pivoted such that all four edges lay against each other. Hinged devices 32 lay along central axis 22 to allow table frame 17 to pivot between the open and closed state.

Figure 1A:
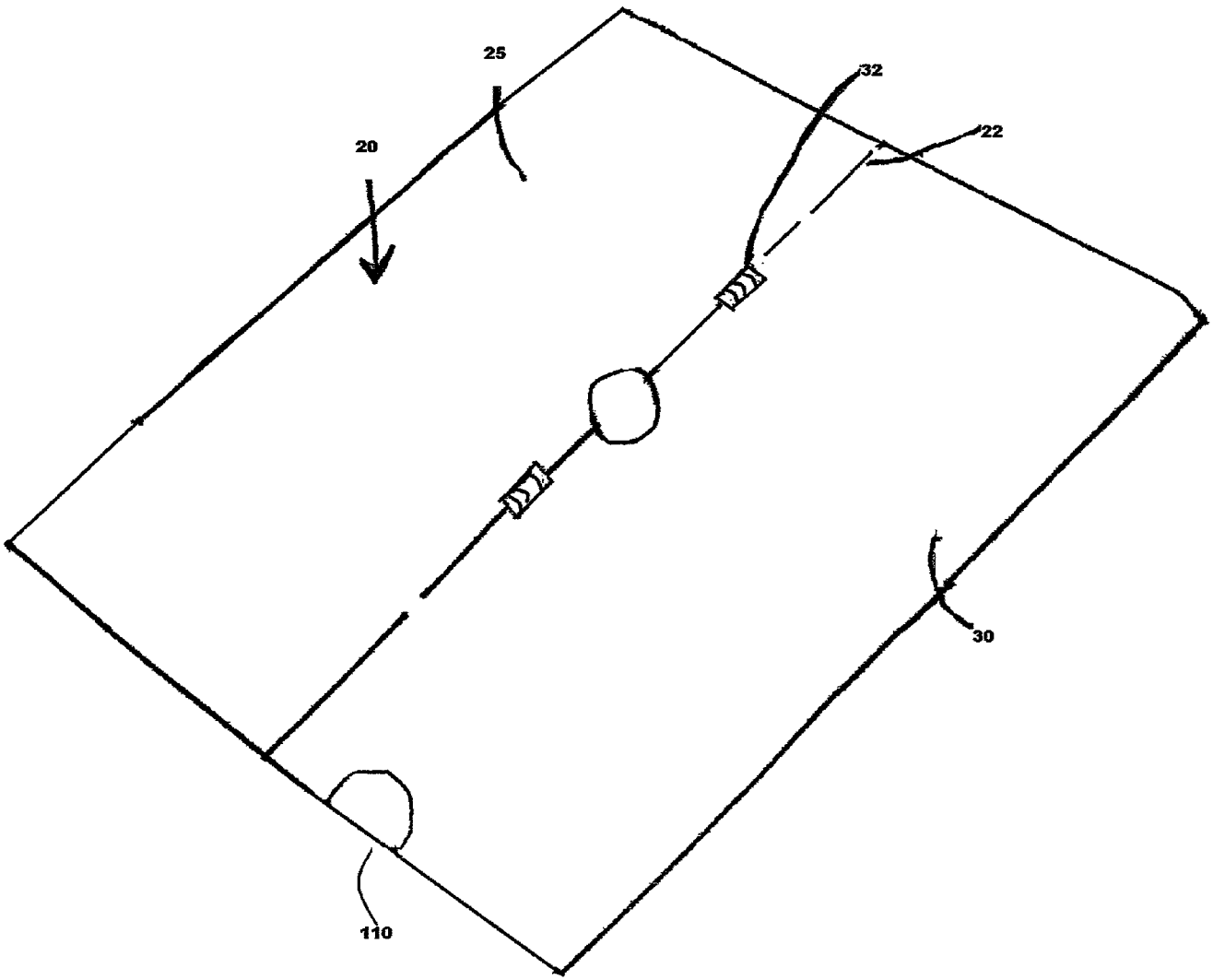
FIG. 1A is a top view of the table insert.

As shown in FIG. 1A, table insert 20 includes have two half sections 20 and 25. As shown, top half sections 20 and 25 are hinged together so that each section can pivot with respect to each other. At least one hinged device 32 is located along the central axis of table insert 20. Thus, allowing table insert 20 to pivot along central axis 22. As shown, top half sections 25 and 30 are hinged together so that each section can' pivot with respect to each other. In the depicted open state, half section 25 and 30 are pivoted such that the two half sections 25 and 30 lay adjacent to each other. However, in the closed state, half sections 25 and 30 are pivoted such that all four edges lay against each other. Hinged devices lay along central axis 22 to allow for pivoting between the open and closed state.

The present invention further comprises a plurality of leg members (40) removably attached using suitable fastening means to each corner of the underside of frame 17. At an intermediate point, each leg member 40 has a hinged device 23 that allow the adjusting the length of the leg. In the preferred embodiment, each leg member can extend linearly downward up to two feet. Also, in the preferred embodiment, each leg member is removably fastened to the underside of frame 17 by screw fasteners.

Figure 5:
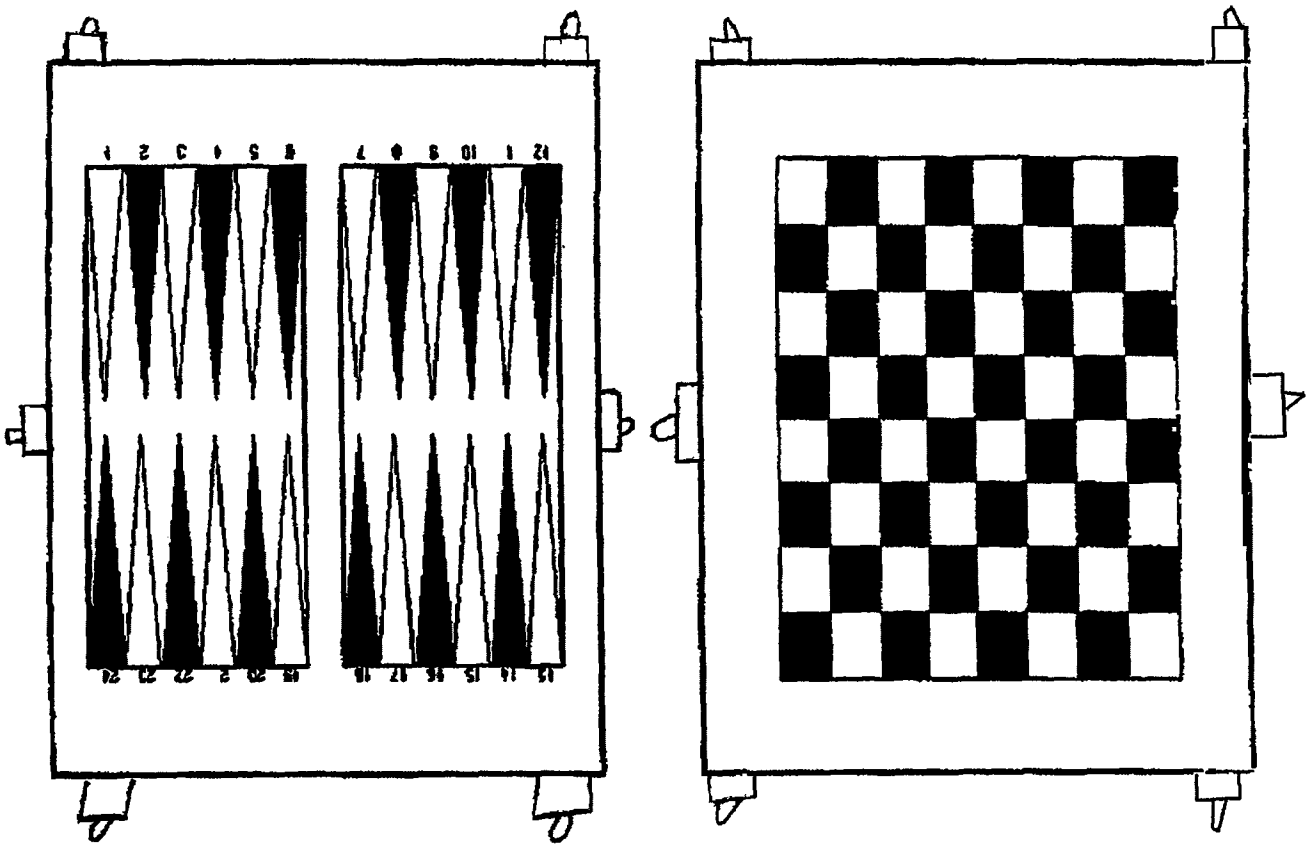
FIG. 5 is top view of the removable insert.

Referring to FIG. 5, there is shown a removable covering (55) for the insert (20) in FIG. 1. The removable covering (55) is adapted with the configuration of the removable table insert. Incorporated upon the surface removable covering (55) can be any game such as chess, checkers, or Chinese checkers. This allow the table to be easily adapted to any game. Additionally, along the perimeter of the covering 55 can be fasteners to allow the removable covering to be secured to the table insert.

Figure 2:
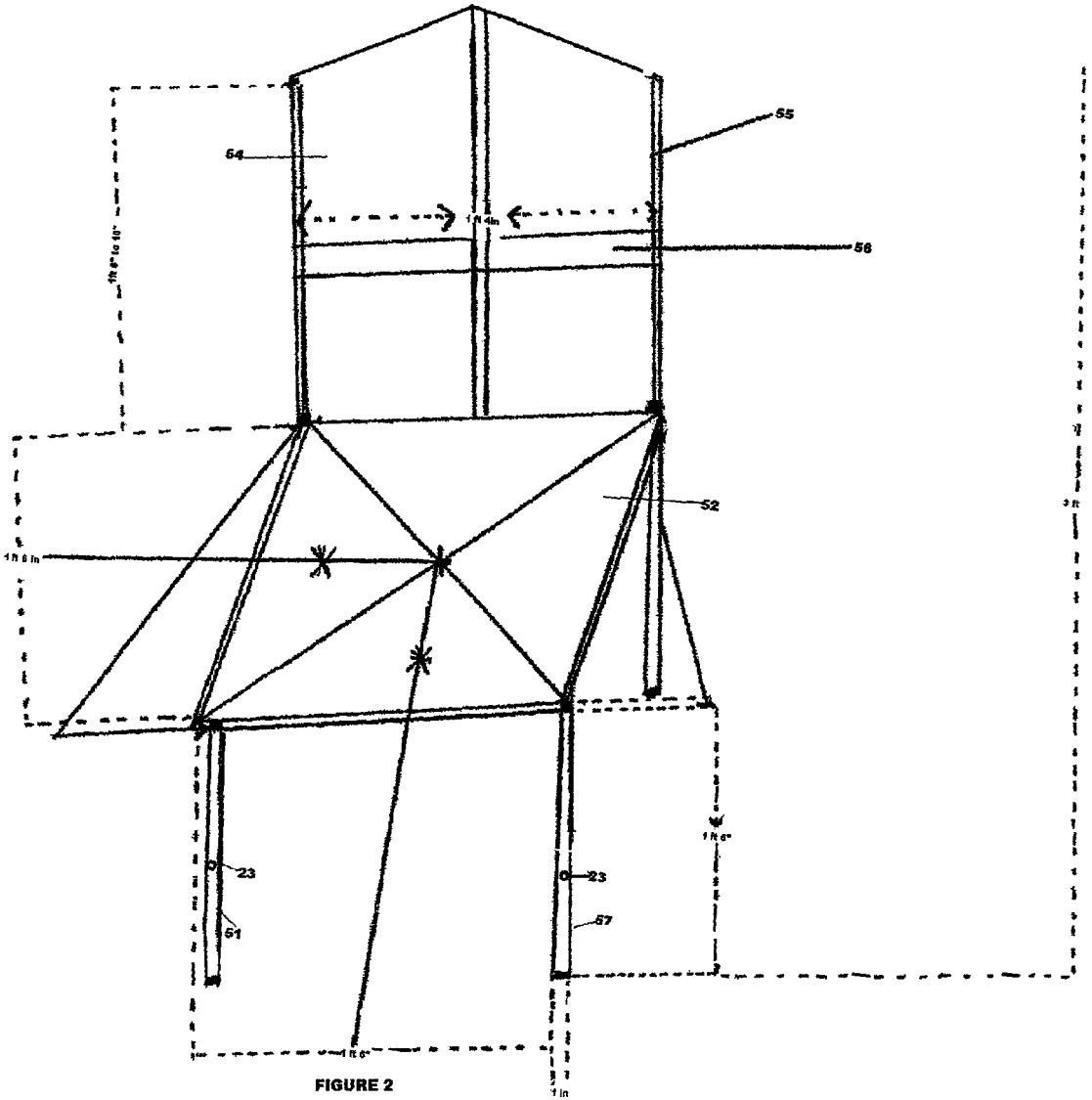
FIG. 2 is a perspective view of the chair.

Referring to FIG. 2 there is shown an embodiment of the collapsible chair 50 in its open state. Chair 50 further comprises a seat portion 52 and a back portion 54. Hinged device 56 pivotally and perpendicularly connect seat portion 52 to back portion 54. In the open state back portion 54 lays perpendicular to seat portion 52. In the closed state (not shown) back portion 54 would overlay seat portion 52. In the preferred embodiment back portion 54 has a pentagon shape with a horizontal back brace 56 and vertical back brace 55.

Chair 50 of the present invention further comprises a plurality of leg members (56) removably attached using suitable fastening means to each corner of the underside of seat portion 52. Each leg member 56 has a hinged device 23 near the middle to allow for adjusting the length of the leg member 56. In the preferred embodiment, each leg member 56 can extend linearly downward up to two feet. Also, in the preferred embodiment, each leg member 56 is removably fastened to the underside of seat portion 52 by screw fasteners.

In the preferred embodiment, back portion 54 can be one and feet 6 inches to one feet and 10 inches in height. As depicted, vertical back brace 55 extends down the central vertical axis of back portion 54 dividing it into two substantially equivalent sections. Additionally, horizontal back brace 56 can extend horizontally across the longitudinal axis of back portion 54 dividing it into four substantially equivalent sections.

In the preferred embodiment, seat portion 52 can be one feet and six inches in length. Both back portion 54 and seat portion 52 can be made of a flexible as well as a stretchable material. The height of chair unfolded in the preferred embodiment is three feet.

Referring to FIGS. 3 and 4, there is shown a carrying case 60 in an opened and closed state. Carrying case 60 is rectangular in shape and is adapted to contain all of the elements of the entertainment assembly. Carrying case 60 further comprises a top portion 62 and bottom portion 70. The interior cavity of top portion 62 further comprises first two pockets 64 aligned adjacent to first compartment 66. Additionally, the interior cavity of bottom portion 70 further comprises second two pockets 72 aligned adjacent to second compartment 74. The first compartment 66 and the second compartment 74 are designed to specifically hold table insert 20, table frame 17 (shown in FIG. 1), and chair 50 shown in FIG. 2. First pockets 64 are designed to contain the four legs for table frame 17 and second pockets 72 are designed to contain the four legs of chair 50.

As shown in FIG. 1, table insert 20 can be designed with additional features. A dry erase board 100 can be implemented in at least one corner of table insert 20. An opening 105 extending through the center of table insert 20 and table frame 17 can be used to receive the elongated pole of a large umbrella for shade. When the opening 105 is not in use, a plug can be used to secure the hole. At least one, cup holder 110 can be installed within the table insert 20 for holding cup and/or glasses. Additionally, dice opening 115 can be placed in the side of table for practicing throwing dice.

What is claim is:

1. A portable entertainment system comprising:

a collapsible table having a frame and a removable insert;

the insert being dissected into two substantially equal half sections;

the frame being dissected into two equal half sections;

the two half sections of the frame being operationally connected to collapse and fold upon each other;

the two half sections of the insert being adapted to collapse and fold upon each other;

an underside of each corner of the frame having a means for securely and removable engaging with a leg member;

the frame having an outer peripheral edge surrounded with a recessed portion incorporated therein;

the insert having an outer peripheral edge configured to seat within the recessed portion of the frame;

a covering configured with a length and a width equivalent to the dimensions of the removable insert;

an underside of the covering removably attached to the removable insert.

a plurality of collapsible chairs with each chair comprising a seat portion and a back portion being supported by removable leg members;

the seat portion pivotally and perpendicularly connecting the back portion;

in an open state the back portion lying perpendicular to the seat;

in a closed state the back portion overlying the seat portion;

a container having a top portion hingedly connected to a bottom portion;

the top portion having a base portion with surrounding sidewalls extending upward to form a first compartment for receiving the frame, the insert and the covering;

the bottom portion having a base portion with surrounding sidewalls extending upward to from second compartment for receiving the chairs;

the first compartment having a first pocket member for receiving each member of the frame;

and the second compartment having a second pocket member for receiving the removable leg members of the chairs wherein the table, frame, and chairs are stored disassembled within the container.

2. The portable system of claim 1 wherein each leg member further comprises a means for adjusting the length thereof.

3. The portable system of claim 1 wherein the back portion having a support member encompassing the back portion having a pentagon shape with an apex point;

the apex point being aligned along a longitudinal axis of the support member;

the support member extending downward to a lower peripheral edge lying adjacent to and abutting a peripheral edge of the seat portion; and a horizontal brace lying substantially across a middle portion of the support member perpendicular to the longitudinal axis wherein a user back is supported while sitting.

4. The portable system of claim 3 wherein the back portion further comprises:

a vertical support brace extending from the apex point along the longitudinal axis to the lower peripheral edge of the support member abutting the peripheral edge of the seat portion wherein a user back is supported while sitting.

5. The portable system of claim 1 wherein the insert further comprises a centrally located opening for receiving an elongated pole which support a large portable umbrella.

6. The portable system of claim 1 wherein the removable covering further comprises:

a top edge, a bottom edge, an two opposing side edges;

the covering having indicia corresponding to a specific game incorporated thereon;

each edge adapted with fasteners for securely attaching the removable covering to a corresponding edge of the insert.

7. The portable system of claim 1 where in the insert further comprises a first cavity located near at least one peripheral edge of the insert dimensioned to receive a bottom portion of a cup.

8. The portable system of claim 1 wherein the insert further comprises a second cavity located near at least one peripheral edge of the insert dimensioned to allow a player to throw a pair of dice.

9. The portable system of claim 1 wherein the insert further comprises a small eraser board with a geometrical shape incorporated within at least one corner of the insert.

10. The portable system of claim 1 wherein the leg members of the chairs are adjustable in length.

11. A method of assembling and disassembly a portable entertainment system comprising:

providing a kit with a frame having two hingedly connected equal half sections;

the two half sections of the frame being hingedly connected thereto, an insert having two hingedly connected equal half sections thereto, a covering, a plurality of chairs having a pentagon shape back portion hingedly connected to a seat portion, leg member of the chairs and leg members of the frame stored disassembled within a container having a top portion hingedly connected to a bottom portion, the top portion having a base portion with surrounding sidewalls extending upward to form a first compartment for receiving the frame, insert, and covering, the bottom portion having a base portion with surrounding sidewalls extending upward to form a second compartment for receiving the chairs, the first compartment having a first pocket member for receiving each leg member of the frame; and the second compartment having a second pocket member for receiving the removable leg members of the chairs wherein the table, frame, and chairs are stored disassembled within the container;

extending the two half section of the frame;

adjusting the leg members of the frame to a particular height;

connecting the leg members to the corners of the frame;

extending the half sections of the insert;

placing the insert within an indentation surrounding a peripheral edge of the frame;

extending the back portion from the seat portion of each chair adjusting the length of leg members of each chair; and connecting the leg members to each chair.

12. The method of claim 11 further comprising providing a kit with the insert having a first cavity located near at least one peripheral edge of the insert dimensioned to receive a bottom portion of a cup.

13. The method of claim 12 further comprising providing a kit wherein the insert further comprises a second cavity located near at least one peripheral edge of the insert dimensioned to allow a player to throw a pair of dice.

14. The method of claim 12 further comprising providing a kit wherein the insert further comprises a small dry eraser board with a geometrical shape incorporated within at least one corner of the insert.

15. A kit for a portable entertainment system comprising:

a collapsible table having a frame and an insert;

the insert being dissected into two substantially equal half sections;

the two half sections of the insert being hingedly connected thereto the frame being dissected into two equal half sections;

the two half sections of the frame being hingedly connected thereto;

an underside of each corner of the frame having a means for threadedly engaging with a leg member;

the frame having an indentation surrounding the peripheral edge thereon;

the indentation configured to removably receive the insert;

a plurality of collapsible chairs with each chair comprising a seat portion;

a back portion being supported by removable leg members;

a connection device pivotally and perpendicularly connecting the seat portion of the back portion;

a covering configured with a length and a width equivalent to the dimensions of the insert;

an underside of the covering reomvably attached to the insert.

in an open state the back portion lying perpendicular to the seat portion;

in the closed state the back portion overlaying the seat portion;

a support member encompassing the back portion having a pentagon shape with an apex point;

the apex point being aligned along a longitudinal axis of the support member;

the support member extending downward to a lower peripheral edge lying adjacent to and abutting a peripheral edge of the seat portion;

a horizontal brace lying substantially across a middle portion of the support member perpendicular to the longitudinal axis;

the back portion having a vertical support brace extending from the apex point along the longitudinal axis to the lower peripheral edge of the support member abutting the peripheral edge of the seat portion wherein a user back is supported while sitting;

a container having a top portion hingedly connected to a bottom portion; the top portion having a base portion with surrounding sidewalls extending upwards from a first compartment for receiving the frame, insert, and covering;

the bottom portion having a base portion with surrounding sidewalls extending upwards from a second compartment for receiving the chairs;

the first compartment having a first pocket member for receiving each leg member of the frame;

and the second compartment having a second pocket member for receiving the removable leg members of the chairs wherein the table, frame, and chairs stored disassembled within the container.

16. The kit of claim 15 further comprising:

a covering having a top edge, a bottom edge, and two opposing side edges;

the covering having indicia corresponding to a specific game incorporated thereon;

each edge adapted with fasteners for securely attaching the removable covering to a corresponding edge of the insert.

17. The kit of claim 15 wherein in the insert further comprises indicia corresponding to a specific game incorporated thereon.

* * * * *